US008915825B2

(12) United States Patent
Elpers

(10) Patent No.: US 8,915,825 B2
(45) Date of Patent: Dec. 23, 2014

(54) MULTI-POSITIONED ANGLED STEP AND RISERS

(71) Applicant: Indian Industries, Inc., Evansville, IN (US)

(72) Inventor: Philip Elpers, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 14/200,715

(22) Filed: Mar. 7, 2014

(65) Prior Publication Data

US 2014/0187386 A1 Jul. 3, 2014

Related U.S. Application Data

(63) Continuation of application No. 13/706,517, filed on Dec. 6, 2012, now Pat. No. 8,696,523, which is a continuation of application No. 13/029,876, filed on Feb. 17, 2011, now Pat. No. 8,348,812.

(60) Provisional application No. 61/306,155, filed on Feb. 19, 2010.

(51) Int. Cl.
*A63B 22/04* (2006.01)

(52) U.S. Cl.
USPC ..... 482/52; 482/51; 482/142

(58) Field of Classification Search
USPC ..... 482/19, 26, 35, 61, 52, 142, 148; 446/85, 106, 120, 124, 125, 117, 476; 434/247, 403; 108/106; 248/188.2, 248/346.5; D21/336, 671, 694
See application file for complete search history.

(56) References Cited

U.S. PATENT DOCUMENTS

| | | | |
|---|---|---|---|
| 3,220,141 | A | 11/1965 | Goss, III |
| 4,441,758 | A | 4/1984 | Fleischer et al. |
| 4,549,767 | A | 10/1985 | Hampshire et al. |
| 4,678,234 | A | 7/1987 | Wilson |
| D330,057 | S | 10/1992 | Saunders et al. |
| D330,234 | S | 10/1992 | Saunders et al. |
| 5,154,678 | A | 10/1992 | Adamczyk et al. |
| 5,158,512 | A | 10/1992 | Irwin et al. |
| 5,234,396 | A | 8/1993 | Wilkinson |
| 5,261,864 | A | 11/1993 | Fitzpatrick |
| D342,298 | S | 12/1993 | Schnabel, Jr. et al. |
| 5,269,735 | A | 12/1993 | Pfitzenmeier |
| 5,277,675 | A | 1/1994 | Shifferaw |
| 5,290,210 | A | 3/1994 | Hand et al. |
| 5,318,489 | A | 6/1994 | Irwin |
| D349,540 | S | 8/1994 | Hand et al. |
| 5,620,404 | A | 4/1997 | Eyman |
| 5,672,144 | A | 9/1997 | Hulme |
| 6,117,051 | A | 9/2000 | Suarez et al. |
| D449,662 | S | 10/2001 | Monter Villar et al. |
| 6,524,355 | B1 | 2/2003 | Jenkins |
| D560,260 | S | 1/2008 | Flentye et al. |
| 7,361,123 | B1 | 4/2008 | Krull |
| 7,922,623 | B2 | 4/2011 | Flentye et al. |
| 7,927,256 | B2 | 4/2011 | Flentye et al. |
| 2006/0189448 | A1 | 8/2006 | Flentye et al. |
| 2006/0189449 | A1 | 8/2006 | Flentye et al. |
| 2009/0095754 | A1 | 4/2009 | Liu |
| 2011/0172063 | A1 | 7/2011 | Flentye et al. |

*Primary Examiner* — Glenn Richman
(74) *Attorney, Agent, or Firm* — Woodard, Emhardt, Moriarty, McNett & Henry LLP

(57) ABSTRACT

An adjustable stepping structure for aerobic exercise is disclosed having a platform and a plurality of support elements. The support elements include a downwardly arcuate notch or channel for receiving a sidewall or endwall of the platform, allowing the platform to be arranged in multiple angled orientations.

20 Claims, 10 Drawing Sheets

MULTI-POSITIONED ANGLED STEP AND RISERS

REFERENCE TO RELATED APPLICATION

The present application is a continuation of U.S. patent application Ser. No. 13/706,517, filed Dec. 6, 2012, which is a continuation of U.S. patent application Ser. No. 13/029,876, filed Feb. 17, 2011, now issued as U.S. Pat. No. 8,348,812, which claims the benefit of U.S. Provisional Patent Application Ser. No. 61/306,155 filed Feb. 19, 2010 entitled MULTI-POSITIONED ANGLED STEP AND RISERS all of which are hereby incorporated by reference in their entirety.

FIELD OF THE INVENTION

The present invention relates to aerobic exercise devices and, more particularly, to an adjustable stepping structure for aerobic exercises.

BACKGROUND OF THE INVENTION

Aerobic exercise platform devices, such as The STEP® are often used in physical fitness regimens to assist in aerobic workouts and simulating climbing or stair activities. One example of these is shown in U.S. Pat. No. 5,158,512. These platforms are typically horizontal with elongate, rectangular shapes having a height simulating a stair step. When a higher step is desired for a more difficult routine, one or more risers can typically be placed under the platform to raise the total height of the platform. A typical platform includes a tread or traction area on the top and a stable base to minimize the risk of a person slipping.

An improved exercise system is desired.

SUMMARY OF THE INVENTION

In one configuration, the present system includes an adjustable top portion or platform with one or more support elements or risers. In certain preferred embodiments, the platform and risers may be placed or arranged to provide various levels of platform height and/or an angled platform surface. Preferably each support element is capable of being telescopingly received within the bottom of the platform section, as well as being received within the bottom of another support element so that they are vertically stackable. In certain embodiments, one or more of the support elements include notches in the top section allowing the platform section to be supported at an angled orientation relative to either the length or width of the platform section.

Preferably the exercise system can be used as a standard horizontal platform or as an angled platform for aerobic exercises, stretching, yoga, or balancing exercises.

It is an object of the invention to provide an improved exercise system.

Further objects, features and advantages of the present invention shall become apparent from the detailed drawings and descriptions provided herein.

DESCRIPTION OF PREFERRED EMBODIMENTS

Figure 1:
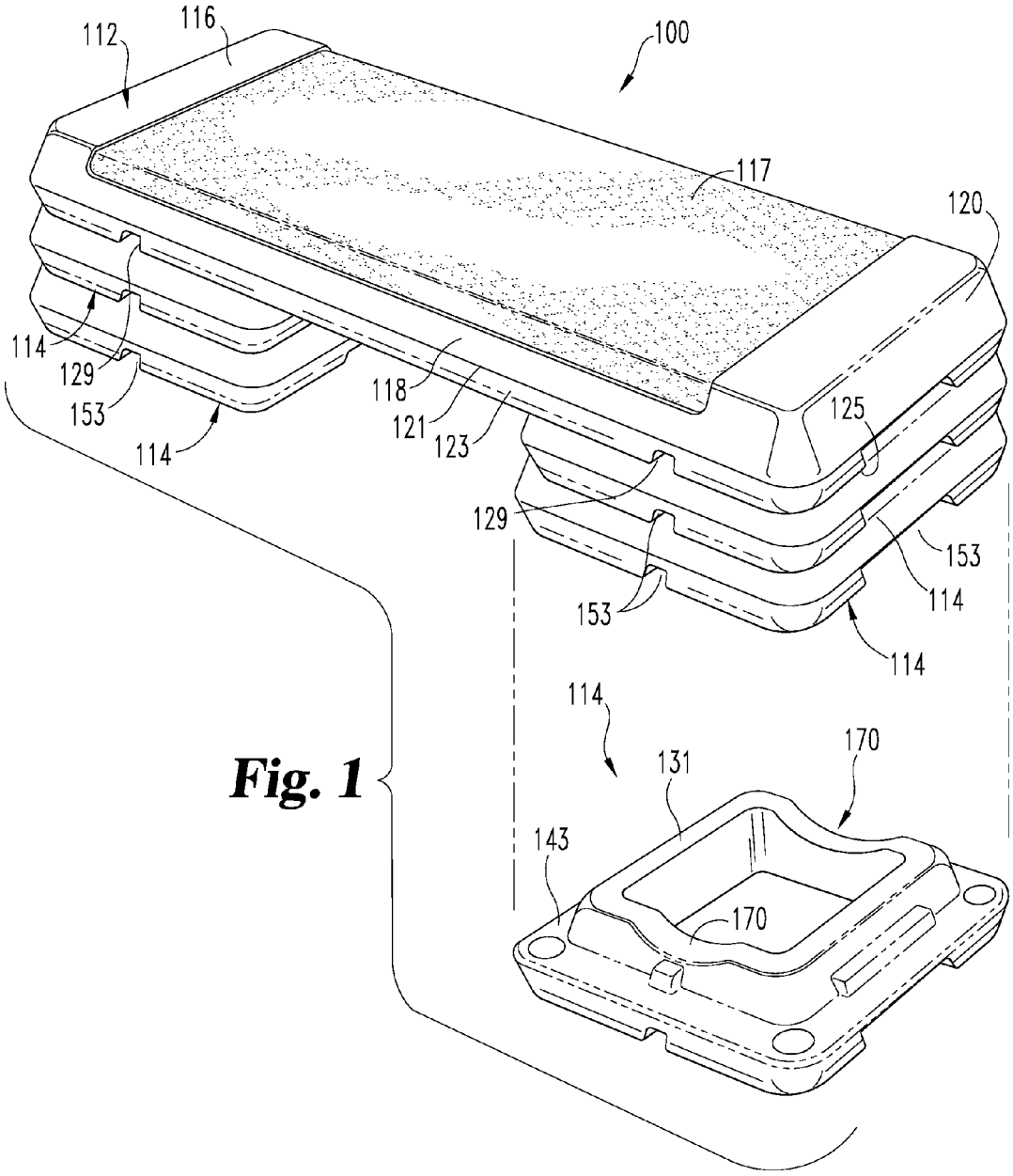
FIG. 1. is an exploded perspective view of an embodiment of the present invention.

For the purposes of promoting an understanding of the principles of the disclosure, reference will now be made to the embodiments illustrated and specific language will be used to describe the same. It will nevertheless be understood that no limitation of the scope of the invention is thereby intended, such alterations, modifications, and further applications of the principles being contemplated as would normally occur to one skilled in the art to which the invention relates.

FIGS. 1-11 depict an example embodiment, denoted generally by the numeral 100, comprising a platform section 112 and a plurality of risers or support elements 114 which provide means for vertically adjusting the height of platform section 112 in a horizontal or angled arrangement above a support surface, such as a floor. The illustrated embodiment 100 is constructed of molded high impact plastic materials.

The platform section 112 is generally rectangular in shape with a length and a width and a substantially planar top with a stepping surface 116 having a non-slip, textured surface or coating 117 thereon. A pair of sidewalls 118 and a pair of endwalls 120 extend downward and optionally slightly outwardly from the top surface 116 to a transition point 121. The walls 118 and 120 then extend further downwardly to lower rounded side edges 123 and end edges 125. Optional openings or passages 129 are provided, for example by molded areas, to aid in maneuvering and aligning the platform section 112.

Figure 2:
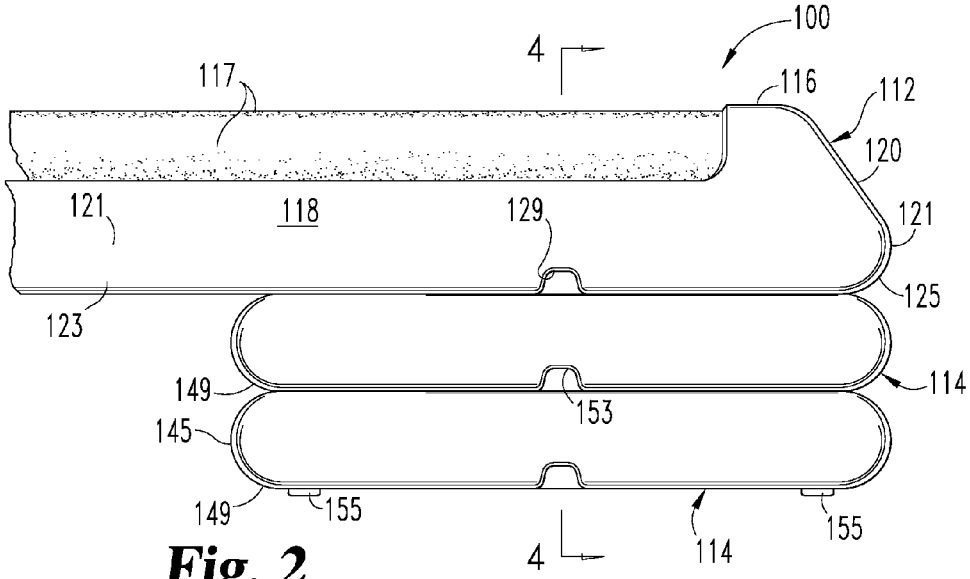
FIG. 2 is a front view of a portion of the embodiment of FIG. 1.
Figure 3:
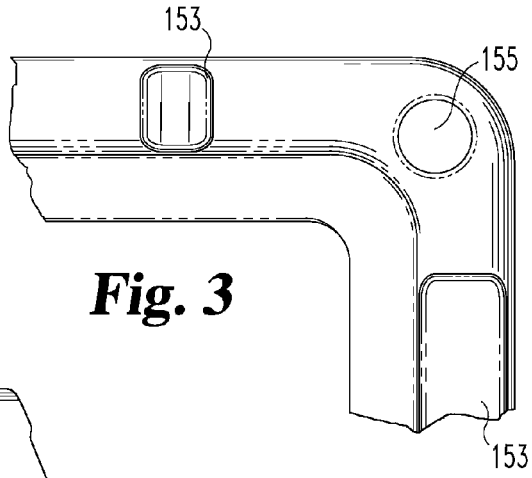
FIG. 3 is a bottom plan view of a portion of one of the support elements of the embodiment of FIG. 1.

As illustrated in FIGS. 1 and 2, each support element 114 is capable of being telescopingly or nestably received within the bottom of the platform section 112, as well as being received within the bottom of another support element 114 so that they are vertically stackable. In certain embodiments, one or more of the support elements further include notches 170 in the top section allowing the platform section to be supported in an angled orientation relative to either the length or width of the platform section. In other words, the platform 112 may oriented with the smaller-width end supported within the notches 170, or oriented with the longer-length side supported within the notches 170.

The illustrated support element 114 is a generally square or rectangular shaped unitary member, preferably with an open center. Each support element includes a top section 131 having a slightly rounded top 133 and downwardly extending outer sidewalls 135. A lower section 143 includes a curved, base portion 145 that terminates in a lower edge 149. Lower section 143 is generally arranged and configured to rest flat upon a support surface or to rest flat upon an underlying support element. The cross-section of top section 131 is substantially parallel to the cross-section of lower section 143. Optional molded openings 153 are formed in the lower edges 149 of support elements 114 to aid in maneuvering and aligning the support elements 114.

Figure 4:
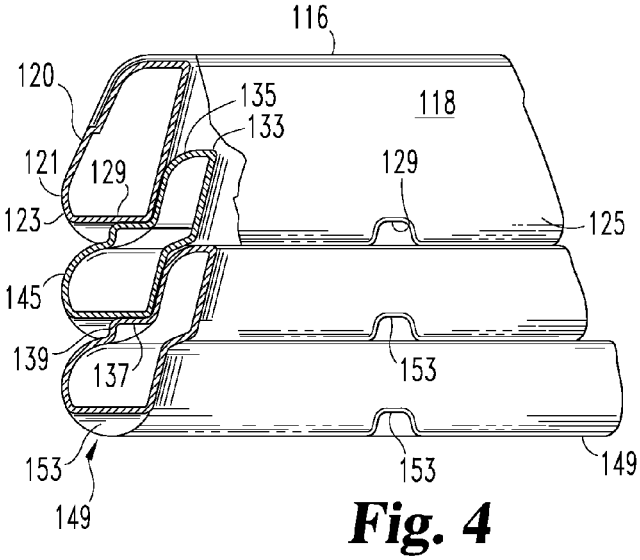
FIG. 4 is a cross-sectional view of the embodiment taken along line 4-4 of FIG. 2.

As seen in a cross-sectional view in FIG. 4, the walls of platform 112 and sidewalls of lower section 143 each include interior wall portions which project downwardly. Preferably the outer cross-section of top section 131 is sized to be telescopingly and internally snugly received adjacent the interior wall portions within the bottom of the platform section 112 or within the bottom of another support element 114 so that one or more support elements 114 and platform 112 may be vertically stacked. In alternate embodiments, a platform may have portions which telescopingly engage a support element, for example by having portions of the platform received within a cavity defined in a support element.

Figure 5:
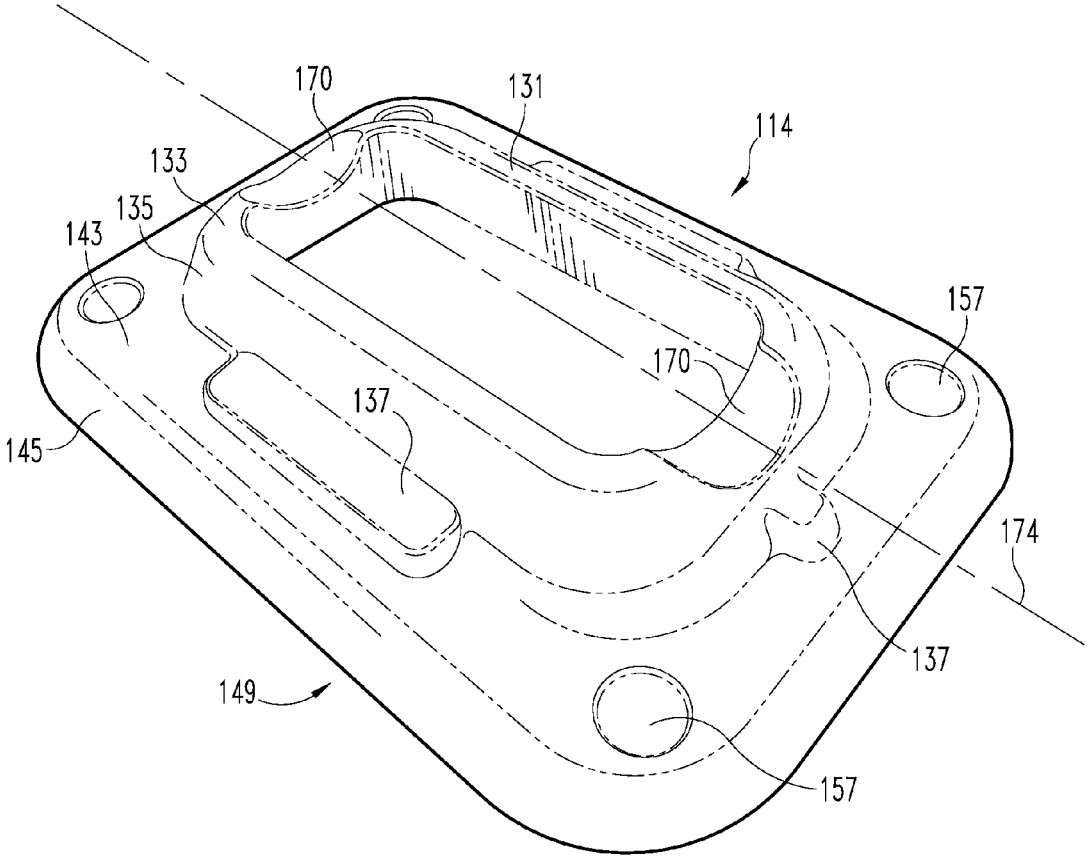
FIG. 5 is a perspective view of a support element of the embodiment shown in FIG. 1.
Figure 6:
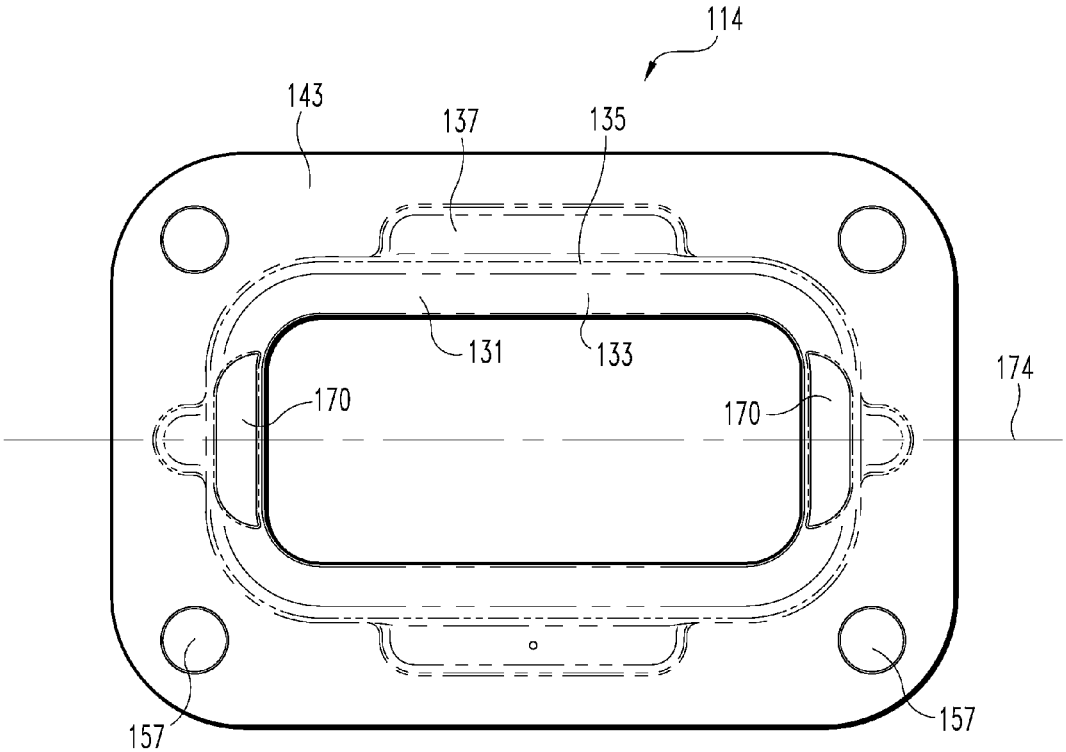
FIG. 6 is a top view of a support element of the embodiment shown in FIG. 1.
Figure 7:
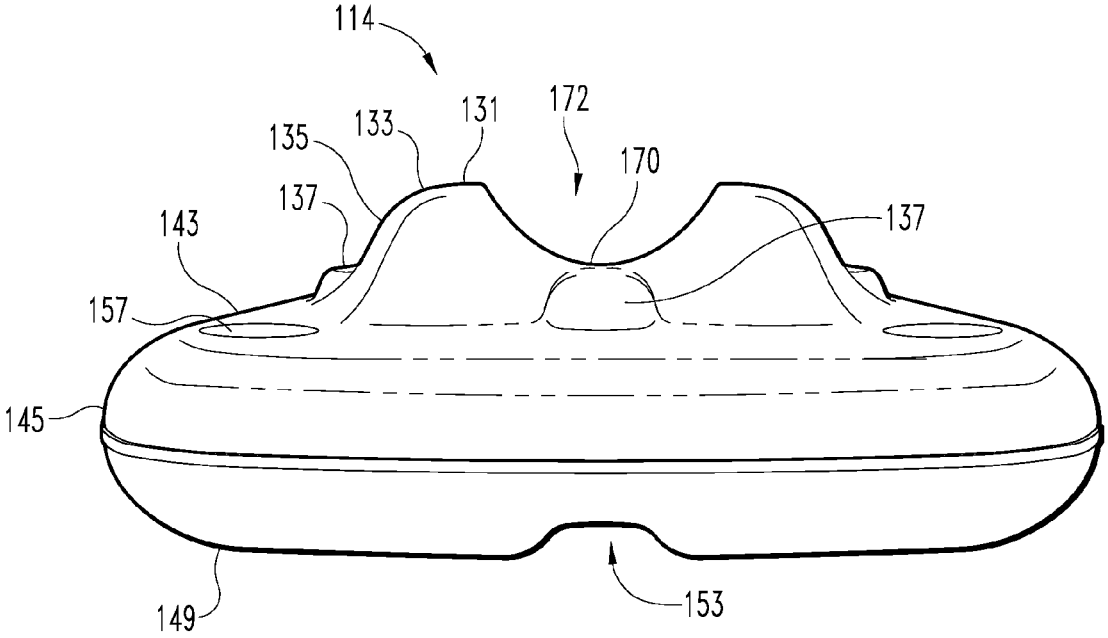
FIG. 7 is a side view of a support element of the embodiment shown in FIG. 1.
Figure 8:
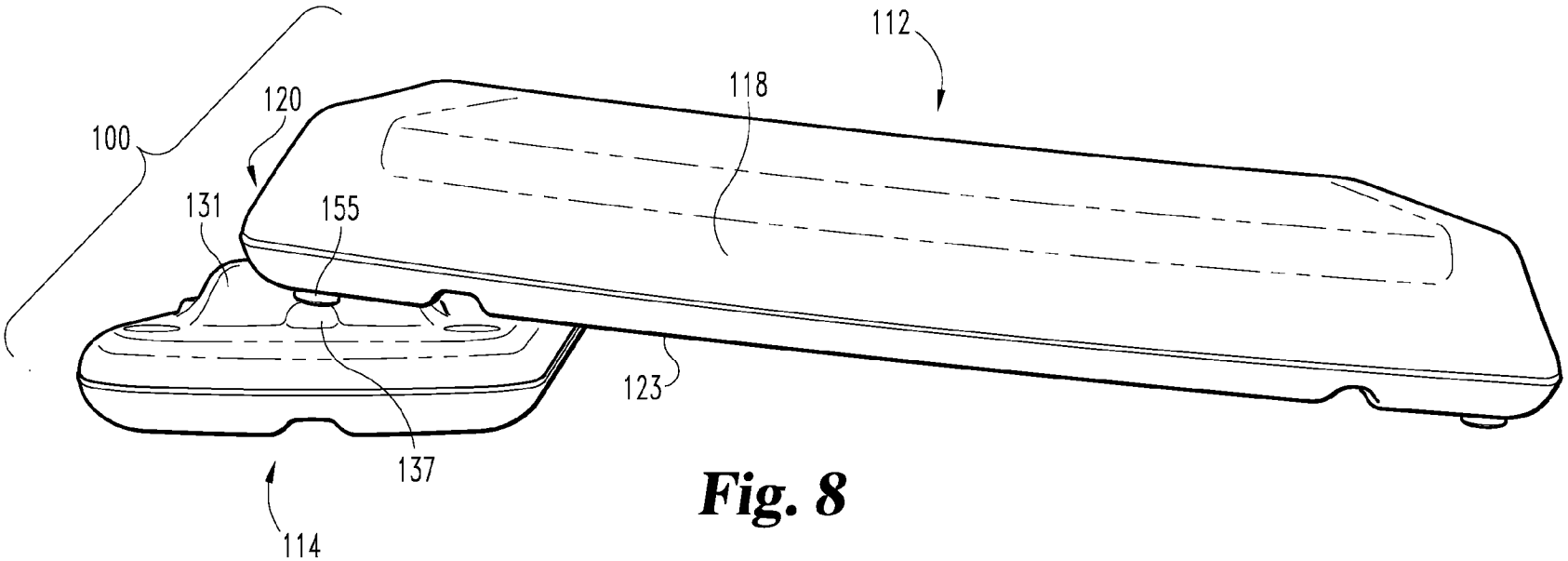
FIG. 8 is a perspective view of a platform supported along a lengthwise angle on a support element.
Figure 9:
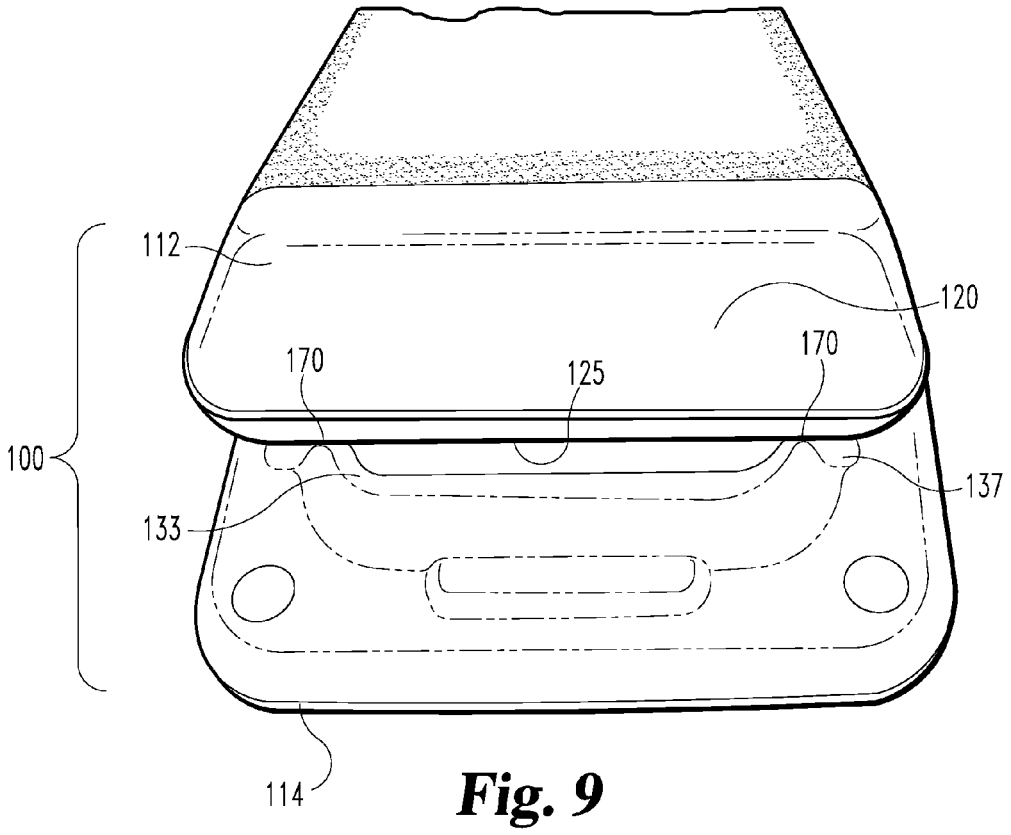
FIG. 9 is a side view of the embodiment of FIG. 8.

In one embodiment, as shown in FIG. 5, the support elements 114 may each include continuous or discontinuous horizontal ledge portions 137. The ledge portions 137 extend outward from sidewall 135 of top section 131 and above lower section 143. In the illustrated embodiment, each support element 114 includes a pair of short ledge portions on two opposing sides of the support element and a pair of longer ledge portions on the other two sides of the support element. In certain embodiments, the top portions of the ledge portions 137 are at a height equal to or slightly below the height of the lowest points of notches 170.

In certain embodiments, ledge portions 137 may be sized and placed to correspond to the positions of molded openings 129 and 153, and can extend horizontally outward to support all or a portion of the thickness of the respective platform or support element sections. In the illustrated embodiments, the pair of short ledge portions are intended to allow a support element 114 to engage in registry with corresponding short molded sections along the sidewalls 123 of platform 112, while the longer ledge portions allow for a support element 114 to be placed at either end of platform 112 with a longer ledge portion of the support element engaging one of the end walls 125 of the platform. The differently sized ledge portions assist in aligning the platform with a support element. The ledge portions 137 may also be used to ensure a desired alignment when multiple support sections 114 are stacked.

Optionally, an element such as a circular foot portion 155 is located at each bottom corner of platform 112 and each support element 114 to engage a support surface or to engage in registry with an upwardly facing depression 157 located on an upper facing surface of an underlying support element. Foot portions 155 preferably assist in supporting, aligning and stabilizing the upper platform and/or support elements in horizontal arrangements.

In certain preferred embodiments, support elements 114 include at least one pair of notches 170 defined in parallel on opposite edges of top section 131. In these embodiments, the rounded top 133 has downward arcuately curved notches 170 with a length equal to or shorter than the length of a sidewall of top section 131. In certain embodiments, the profile of notches 170 substantially corresponds to the profile of the lower edges of sidewalls 123 and endwalls 125 of platform 112. The profile of the notches may include such properties as length, width, depth, radius, cross section, or other dimensional properties.

Preferably, notches 170 are arranged in parallel pairs aligned both vertically and horizontally to define a channel 172 with a horizontal axis 174 crossing the top of the support element 114. While illustrated with one pair of notches, in alternate embodiments two pairs of notches can be formed with one notch in each side of top section 131. Alternately, multiple notches of greater or lesser length and depth can be defined along a side of top section 131 to define alternately selectable horizontal channels and angular arrangement.

In preferred embodiments, notches 170 have sufficient size in length and depth to receive either a lengthwise lower edge 123 of a sidewall 118 or a shorter width-wise lower edge 125 of an endwall 120 of platform 112. In one configuration, shown in FIGS. 8 and 9, a pair of notches 170 receive and support a first endwall 125 at a raised height, to support platform 112 in an angled arrangement along the length of platform 112, with the second endwall of the platform supported at a lower height, typically by a support surface such as the floor.

Figure 10:
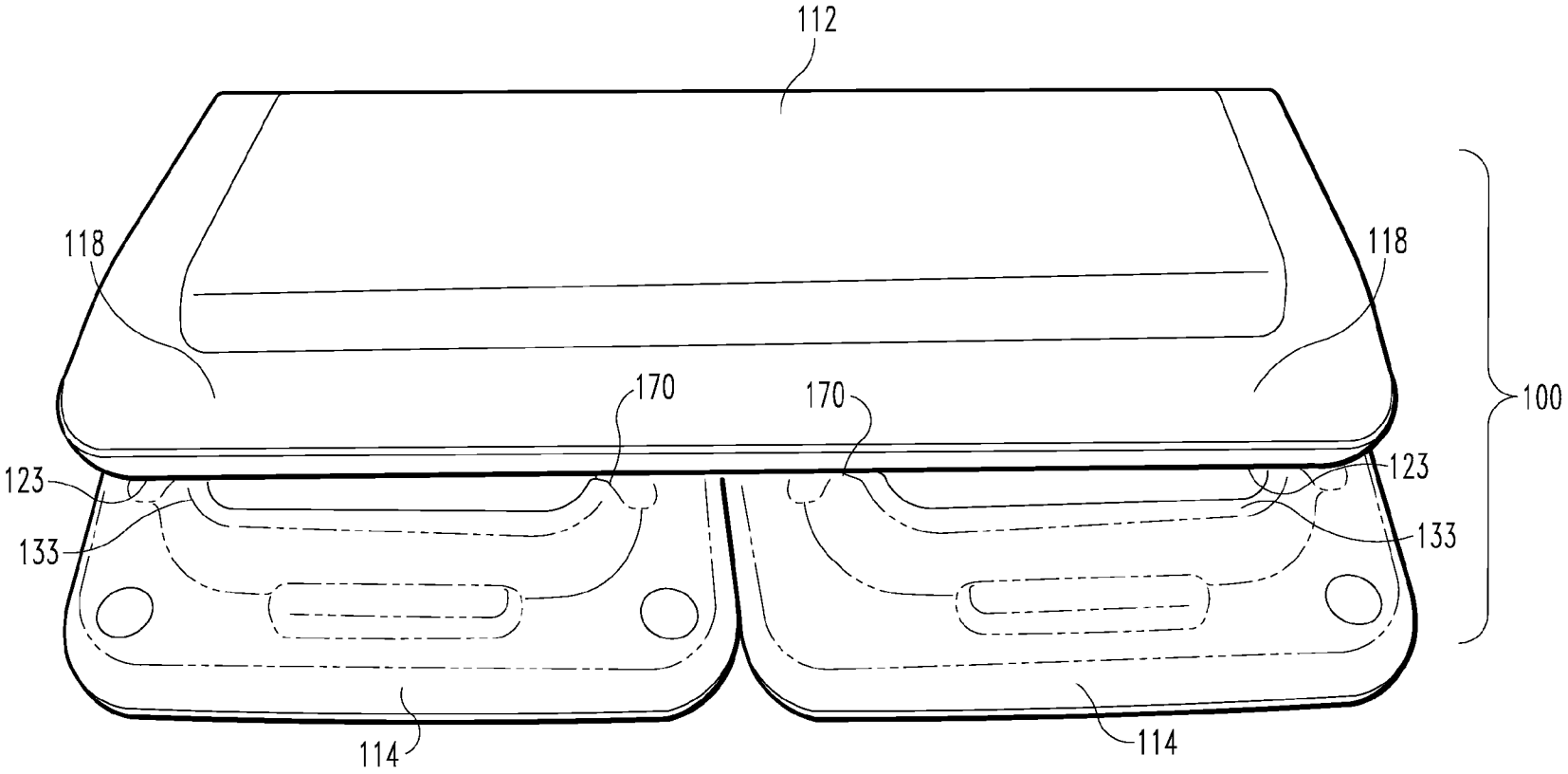
FIG. 10 is a front view of a platform supported along a widthwise angle on two support elements.
Figure 11:
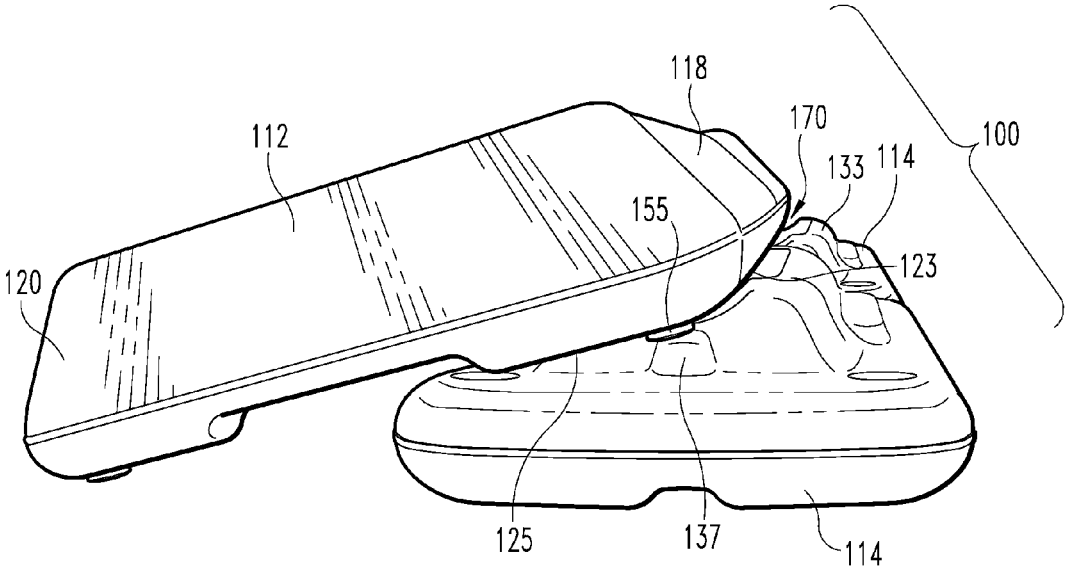
FIG. 11 is a side view of the embodiment of FIG. 10.

In an alternate configuration, shown in FIGS. 10 and 11, a pair of notches 170 receive the edge 123 of a sidewall 118 along the length of platform 112. In this configuration, the support element 114 supports the sidewall edge 123 at a raised height, supporting platform 112 at an angled arrangement along the shorter width of platform 112, with the opposite sidewall of the platform 112 supported at a lower height, typically by a support surface such as the floor. In certain embodiments, more than one support element 114 with parallel aligned notches 170 can be arranged and spaced along the length of a sidewall to provide stability via support points spaced along the length of the platform.

In certain angled arrangements, for example as illustrated in FIGS. 8-11, foot portions 155 assist in supporting, aligning and stabilizing the upper platform over the support elements. For example, foot portions 155 can be sized and placed so the lower surface of the foot portion rests upon the upper surface of a ledge portion 137, such as the short ledge portions illustrated. Preferably, the foot portions 155 are made from a non-slip material to assist in supporting the platform without undesired movement.

Notches 170 preferably have a length and depth sufficient to inhibit the edges of the platform 112 from slipping out of the notches 170 during use of an angled arrangement. In certain optional embodiments, a non-slip texture or surface material may be mounted in the notches 170 and/or along the lower edges of the platform's sidewalls and end walls to further reduce the risk of slippage during use. In still further embodiments, separate engagement features such as fasteners could be used to secure the platform sidewall or endwall in a notch with a desired placement and/or orientation. Examples of such engagement features include pegs or gear teeth extending upward within notches 170, below the height of the upper plane of top section 131, which engage corresponding openings or gearing on the lower edges of the platform.

Figure 12:
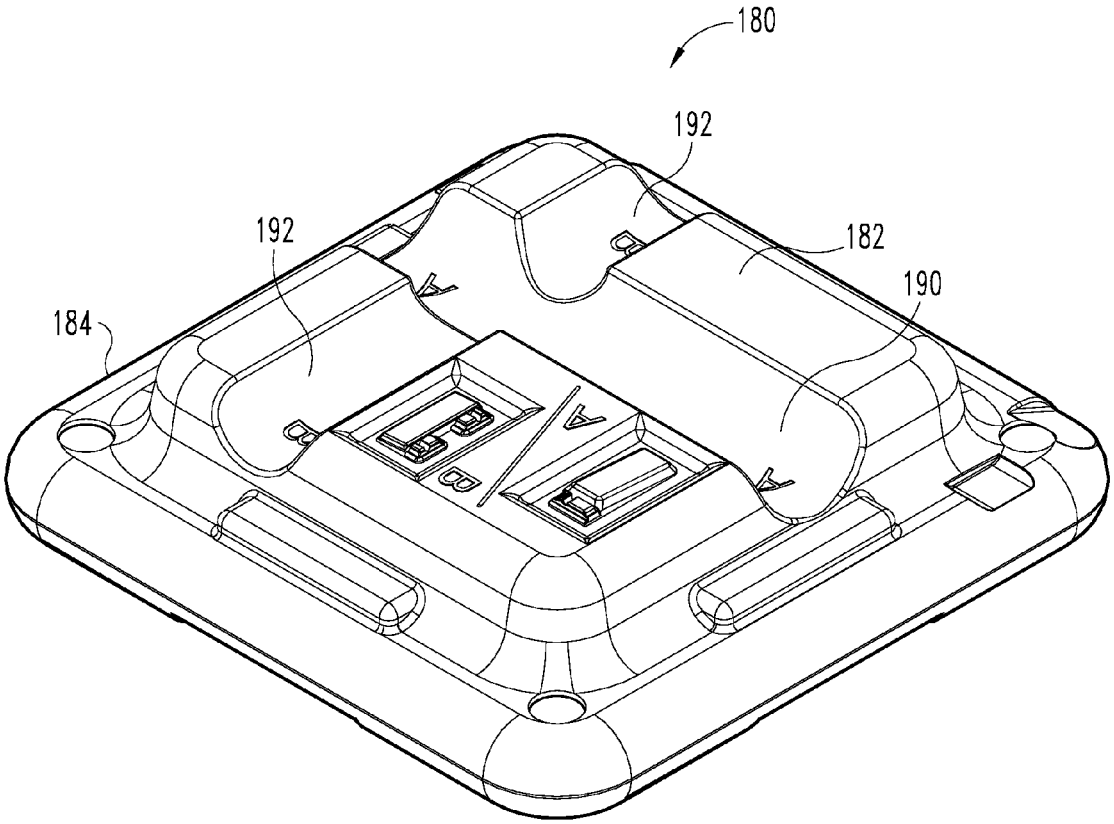
FIG. 12 is a perspective view of a support element according to a further embodiment for use with the platform of FIG. 1.

FIG. 12 shows another embodiment of a generally rectangular support element 180 for use with platform 112 and having an upper portion 182 and a lower portion 184. As illustrated, the support element 180 includes a closed center with two perpendicularly-opposed notches 190 and 192. The profile of the notches 190 and 192 may be sized to accommodate different lower surfaces of a platform 112 or to allow support element 180 to be used to support different sizes or models of platforms. For example, notch 190 may be correspond to the profile of the lower edge of endwalls 125 of platform 112, thereby allowing platform 112 to be supported in a lengthwise angled arrangement, similar to that shown in FIGS. 8 & 9. Likewise, notch 192 may be sized to correspond to the radius and thickness of the lower edge of sidewalls 123 of platform 112, thereby allowing platform 112 to be supported in a widthwise angled arrangement upon two support elements 180, similar to that shown in FIGS. 8 & 9. The notches 190 and 192 may optionally be laterally offset towards one side of the support element to facilitate better fitment when platform is placed in an angled orientation. In certain embodiments, the notches may form channels which may be fully or partially-continuous across the length of upper portion 182. The notches may be also be non-continuous, such as notch 192, which is fully intersected by notch 190.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An adjustable stepping structure for aerobic exercise, comprising:

an elongated platform having a top surface for stepping and sidewalls extending downward from the top surface; and at least two support elements, said support elements having an upper portion and a base, said base extending laterally outward from said upper portion;

wherein the platform can be supported in a horizontal orientation relative to a floor surface by placing the platform on top of the at least two support elements, with the upper portion of the support elements formed to nest within a lower interior portion of the platform between said sidewalls;

wherein the platform can be supported in a first angled orientation relative to the floor surface by placing a first end of the platform on the floor surface and a second end of the platform on a first one of the support elements, the second end of the platform and the first support element secured together by a notch interface.

2. The adjustable stepping structure of claim 1, wherein the platform is substantially rectangular having sidewalls and endwalls and can be supported in a second angled orientation relative to the floor surface by placing a first sidewall of the platform on the floor surface and a second sidewall of the platform on the at least two support elements; and wherein a first angle of the top surface with respect to the floor surface in the first angled orientation is less than a second angle of the top surface with respect to the floor surface in the second angled orientation.

3. The adjustable stepping structure of claim 1, wherein the at least one two support elements have an open center cavity.

4. The adjustable stepping structure of claim 1, wherein the at least one two support elements have a telescoping relationship.

5. The adjustable stepping structure of claim 1, wherein the upper portion of said support elements is formed to nest within a lower portion of an upper adjacent support element.

6. The adjustable stepping structure of claim 1, wherein the platform can be supported in a third angled orientation relative to the floor surface by placing a first end of the platform on the floor surface and a second end of the platform on a first support element, said first support element being vertically stacked upon a second support element.

7. The adjustable stepping structure of claim 6, wherein the upper portion of said second support element is formed to nest within a lower portion of said first support element.

8. The adjustable stepping structure of claim 1, wherein said notch interface comprises a non-slip surface.

9. The adjustable stepping structure of claim 1, wherein said notch interface comprises a tab-in-notch interface.

10. The adjustable stepping structure of claim 1, wherein said notch interface comprises at least two notches.

11. An adjustable stepping structure for aerobic exercise, comprising:

an elongated platform having a top surface for stepping and sidewalls extending downward from the top surface; and at least one support element, said support elements having an upper portion and a base, said base extending laterally outward from said upper portion;

wherein the platform can be supported in a horizontal orientation relative to a floor surface by placing the platform on top of the support element, with the upper portion of the support element formed to nest within a lower interior portion of the platform between said sidewalls;

wherein the platform can be supported in a first angled orientation relative to the floor surface by placing a first end of the platform on the floor surface and a second end of the platform on the support element, the second end of the platform and the first support element secured together by a notch interface between the sidewall of the platform the upper portion of the support element.

12. The adjustable stepping structure of claim 11, wherein the platform is substantially rectangular having sidewalls and endwalls and can be supported in a second angled orientation relative to the floor surface by placing a first sidewall of the platform on the floor surface and a second sidewall of the platform on two support elements; and wherein a first angle of the top surface with respect to the floor surface in the first angled orientation is less than a second angle of the top surface with respect to the floor surface in the second angled orientation.

13. The adjustable stepping structure of claim 11, wherein the support element has an open center cavity.

14. The adjustable stepping structure of claim 11, wherein the upper portion of the support element is formed to nest within a lower portion of an upper adjacent support element.

15. The adjustable stepping structure of claim 11, wherein the platform can be supported in a third angled orientation relative to the floor surface by placing a first end of the platform on the floor surface and a second end of the platform on a first support element, said first support element being vertically stacked upon a second support element.

16. The adjustable stepping structure of claim 15, wherein the upper portion of said second support element is formed to nest within a lower portion of said first support element.

17. The adjustable stepping structure of claim 11, wherein said notch interface comprises a non-slip surface.

18. The adjustable stepping structure of claim 11, wherein said notch interface comprises a tab-in-notch interface.

19. The adjustable stepping structure of claim 11, wherein said notch interface comprises at least two notches.

20. An adjustable stepping structure for aerobic exercise, comprising:

an elongated platform having a top surface for stepping and sidewalls extending downward from the top surface; and at least two support elements, said support elements having an upper portion, a base, and an open center, said base extending laterally outward from said upper portion;

wherein the platform can be supported in a horizontal orientation relative to a floor surface by placing the platform on top of the at least two support elements, with the upper portion of a first support element formed to nest within a first lower interior portion of a first end of the platform between said sidewalls and the upper portion of a second support element formed to nest within a second lower interior portion of a second end of the platform between said sidewalls;

wherein the platform can be supported in a first angled orientation relative to the floor surface by placing a first end of the platform on the floor surface and a second end of the platform on a first one of the support elements, the second end of the platform and the first support element secured together by notch interface.

* * * * *